United States Patent [19]

Hicks

[11] 4,031,009

[45] June 21, 1977

[54] COMBINED LEACHING AND SUMP CATCH-BASIN

[76] Inventor: Robert M. Hicks, 124 Main St., Westford, Mass. 01886

[22] Filed: Oct. 9, 1975

[21] Appl. No.: 620,866

Related U.S. Application Data

[63] Continuation of Ser. No. 455,790, March 28, 1974, abandoned.

[52] U.S. Cl. ..... 210/164; 61/11; 210/170

[51] Int. Cl.[2] ..... B01D 21/10

[58] Field of Search ..... 61/11; 210/164, 532 S, 210/170

[56] References Cited

UNITED STATES PATENTS

| | | | |
|---|---|---|---|
| 913,338 | 2/1909 | Williams | 210/164 X |
| 2,767,801 | 10/1956 | Fads | 61/11 X |
| 3,057,796 | 10/1962 | Davis | 210/532 S X |
| 3,451,553 | 6/1969 | Davis | 210/170 |
| 3,501,007 | 3/1970 | Davis | 61/11 X |

*Primary Examiner*—Frank A. Spear, Jr.
*Attorney, Agent, or Firm*—Pearson & Pearson

[57] ABSTRACT

A pre-cast reinforced concrete catch-basin of larger than conventional catch-basin dimensions includes a solid horizontal bottom wall with solid, hollow, cylindrical side wall upstanding therefrom to about half the height of the catch-basin. The lower half thus forms a sealed, unapertured, undrained, sump receptacle for collecting drain water and silt and allowing sand to settle out. The hollow, cylindrical, upper half contains leaching openings which extend through from the inside to the outside of the wall, from top to bottom, for discharging cleared water to the surrounding, stone-lined, earth without plugging, or clogging, and without polluting nearby wells, brooks, etc.

3 Claims, 2 Drawing Figures

COMBINED LEACHING AND SUMP CATCH-BASIN

RELATED APPLICATION

This application is a continuation of my application Ser. No. 455,790 filed Mar. 28, 1974, now abandoned.

BACKGROUND OF THE INVENTION

Catch-basins have long been used for disposing of surface drainage at a point where a street gutter discharges into a sewer pipe, to catch matter which would not readily pass through the sewer. Such catch-basins may also serve as a reservoir to catch and retain surface drainage. They are usually provided with solid, upstanding, hollow, cylindrical walls of thick, water-impervious concrete with a sewer pipe or drain entering proximate the bottom wall, as disclosed in U.S. Pat. Nos. 821,675 to Shaw of May 29, 1906; 1,391,336 to Meiners of Sept. 20, 1921; 1,712,510 to Monie of May 14, 1929; 3,695,153 to Dorris of Oct. 3, 1972; and 3,715,958 to Crawford of Feb. 13, 1973. Except for an occasional outlet or inlet pipe hole in the side wall of these drainage catch-basins, the upper section of the side wall is unapertured and does not leach water into the surrounding earth. The lower portions are not sealed sump receptacles for retaining silt and sand, but such silt and sand would flush right out the bottom drains with the water.

The prior art also contains a line of patents covering conduit manholes which are underground and are for the purpose of repelling water and surface drainage, rather than collecting it, so as to protect utility lines while enabling a workman to climb down therewithin without becoming wet. Such conduit manholes are exemplified in U.S. Pat. Nos. 12,205 to Baker of Mar. 22, 1904; 810,855 to Haller, et al, of Jan. 23, 1906; and 261,649 to Apple of 1882. In this type manhole, the side walls are water-impervious and free of apertures throughout their height, no surface or subsurface water is intended to be admitted, and a drain is invariably provided in the bottom wall to discharge any moisture which may find its way into the manhole.

SUMMARY OF THE INVENTION

In this invention, a pre-cast reinforced concrete body, preferably having a horizontal bottom wall, a hollow cylindrical side wall, and the conventional top cone and metal grill and metal frame, is provided to serve as a catch basin, not as a water-free conduit manhole. The bottom wall is solid and water-impervious, as is substantially the lower half of the upstanding integral side wall, both being free of apertures, drains, etc. and together forming a silt and sand collecting sump and reservoir for retaining and settling surface water.

Substantially, the upper half of the side wall of the body, however, is provided with a plurality of spaced leaching apertures, spaced from top to bottom thereof, and each extending from inside to outside of the wall, so that the device of the invention comprises a solid bottom section, a lower sump section and an upper leaching section. Piping may be provided into the upper leaching section if desired, but the operation still comprises the collection of surface drainage in the lower section with pollutants settling therein without plugging the upper section, and the discharge of clear, unpolluted water from the upper section into the ambient environment, such as earth, crushed stone, etc., or into a discharge sewer pipe. The body is made larger than the conventional catch-basin to permit the performance of both settling and leaching, even in the event of storm or flood conditions. The water level is thus tended to be maintained in the area; pollutants are prevented from reaching sewers, brooks and rivers; and the maximum water is allowed to leach into the surrounding earth before discharging into a direct run-off conduit.

DESCRIPTION OF THE PREFERRED EMBODIMENT

Figure 1:
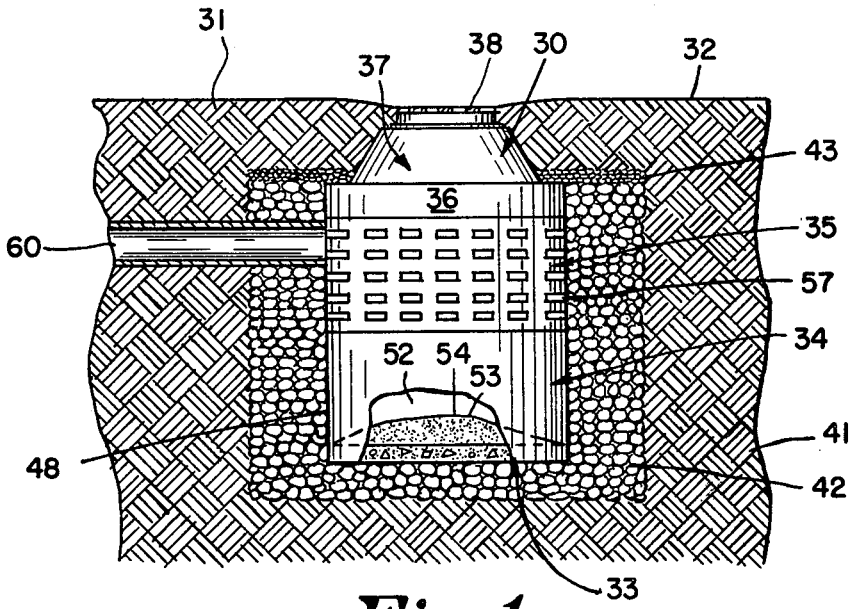
FIG. 1 is a side elevation of a catch-basin of the invention in the ground, with parts broken away.
Figure 2:
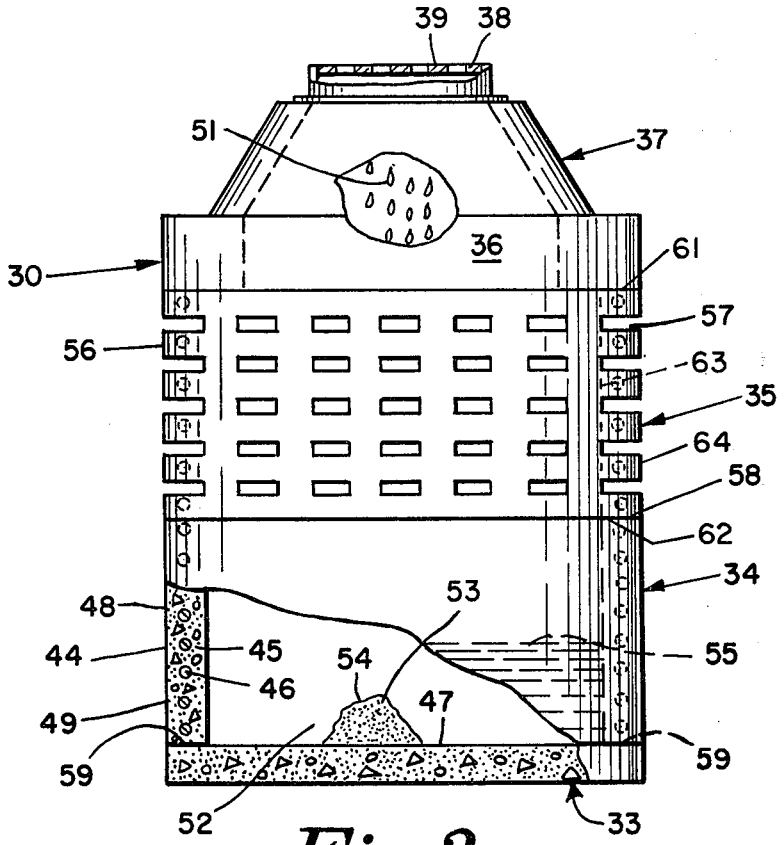
FIG. 2 is a view similar to FIG. 1 of the said catch-basin, on an enlarged scale.

In the drawing, a preferred embodiment of the combined leaching and sump catch-basin 30 of the invention is shown in FIG. 1 as installed in the ground 31 below a road level 32. Catch-basin 30 is preferably larger than conventional size with an outside diameter of six feet and a total height of about ten feet from the bottom section 33, through the sump section 34, leaching section 35, spaces 36, cone 37, cast iron frame 38, and grille 39. The surrounding soil is designated 41 and usually crushed stone 42 and peastone 43 are provided to retain the water discharged from the leaching Section 35. The stone 42 forms a vertical cylindrical wall which defines a cylindrical hole in the earth filled by the oversize catch basin 30.

The drainage catch-basin 30 comprises an upstanding hollow body 44 of pre-cast reinforced concrete 45 usually having a cold drawn steel mesh rod reinforcement 46, although it could be of other moldable material if desired. The concrete 45 is water-impervious and the horizontal bottom wall 47 and integral upstanding side wall 48 is relatively thick, for example about six inches.

The hollow body 44 may be cast in one piece, or it may be pre-cast, as shown, in three pieces, namely the sealed, solid, drain-free, unapertured, lower or sump section 34, the horizontal solid bottom section 33, and the apertured upper or leaching section 35, all joint sealed to form a unitary body. Usually the side wall 48 is hollow cylindrical in configuration.

The lower or sump section 34, unlike prior art catch basins and conduit manholes, is not intended to discharge collected surface water 51 into the ambient environment, such as the soil 41, but includes the solid unapertured side wall portion 49, forming a sealed, undrained, unapertured sump receptacle 52 in which pollutant matter 53, for example salt, sand, leaves, etc., will accumulate in a pile 54, as shown, and not plug or clog drain holes or pass out through a drain or sewer. After the pollutants 53 have so settled, the cleared water 55 rises to the level of the leaching section 35.

The upper or leaching section 35 is provided with an upper apertured side wall portion 56 having a pattern of leaching holes or apertures 57, spaced from top rim 61 to bottom rim 62, each about two inches by three inches in area, and each extending through wall 56 from the inside face 63 to the outside face 64 thereof, for leaching out the cleared water 51 into the ambient environment to enrich and retain the level of the water table, while remaining free of clogging foreign matter.

The horizontal bottom wall 47 can be integrally precast with the lower side wall 49 to form the sump of the invention, but preferably the bottom wall 47, lower side wall 49, and upper side wall 56 are connected to each other by sealing joints 58 and 59 which may be tarred, or may be any well known type of rib-and-groove joint used with manhole risers.

A discharge pipe 60 may be provided in the leaching section to direct liquid into a sewer or nearby brook. The sump section is preferably about three feet high and about half the six-foot height of the body 44.

I claim:

1. In a surface drainage system the combination of:

a generally cylindrical wall of stone formed in the earth and extending vertically below ground surface level to define a hole of predetermined depth and breadth greater than conventional catch basin dimensions;

a pre-cast, reinforced concrete, catch basin of predetermined, oversize height and breadth substantially filling said hole, and of hollow cylindrical configuration, said catch basin having:

a solid circular bottom wall;

a solid, hollow, cylindrical, lower side wall, of uniform annular cross section upstanding from said bottom wall to substantially half the height of said catch basin, and sealed by a sealing joint to said bottom wall, to form a sealed, unapertured, undrained sump receptacle for collecting drain water, silt, leaves and the like up to substantially half the volume of said catch basin without leakage into the surrounding environment;

a solid, hollow, cylindrical, upper side wall, upstanding from said lower side wall and having a pattern of leaching apertures spaced from top to bottom thereof, each aperture extending from the inside to the outside of said upper side wall for leaching cleared water, rising from said sump receptacle up to the level of said apertures, out into said wall of stone and surrounding earth, a sealing joint connecting said upper side wall to said lower side wall and cone and grille means forming an opening at the top of said catch basin for receiving surface drainage.

2. A drainage catch basin comprising:

a pre-cast, reinforced concrete, hollow body having cone and grille means forming an opening at the top to receive surface drainage; said body being of predetermined, oversize height and breadth and having a one piece, solid, lower, vertical, side wall sealed to a solid horizontal bottom wall and upstanding therefrom to about half the height of said body to form a sealed, unapertured, undrained sump receptacle for collecting drain water, silt, leaves and the like up to substantially half the volume of said catch basin, and a one piece, solid, upper, vertical side wall, upstanding from said lower side wall for substantially the remaining half height of said body, said upper side wall having a pattern of leaching apertures spaced from top to bottom thereof, each aperture extending from the inside to the outside of said upper side wall for leaching cleared water rising from said sump receptacle up to the level of said apertures, out into the surrounding environment, and a sealing joint connecting said upper side wall to said lower side wall.

3. A combination as specified in claim 2 wherein:

said catch basin is cylindrical with an outside diameter of six feet, a height of about ten feet and apertures in the upper leaching side wall of about two inches by three inches in area;

whereby said catch basin will resist clogging and plugging under unusual storm conditions.

* * * * *